United States Patent [19]

Klinge

[11] 4,192,326

[45] Mar. 11, 1980

[54] HAIR STYLING IMPLEMENT

[76] Inventor: Gerald E. Klinge, 5637 Dunk Dr., Indianapolis, Ind. 46224

[21] Appl. No.: 920,132

[22] Filed: Jun. 28, 1978

[51] Int. Cl.[2] ..... A45D 2/12

[52] U.S. Cl. ..... 132/34 R

[58] Field of Search ..... 132/34 R, 11 R, 11 A, 132/33, 85, 37; 74/22; 15/201, 184; 219/222, 241, 511

[56] References Cited

U.S. PATENT DOCUMENTS

| | | | |
|---|---|---|---|
| 2,514,244 | 7/1950 | Kemp | 132/34 R |
| 3,204,469 | 9/1965 | Spillers | 74/22 |
| 3,349,782 | 10/1967 | Sawin | 132/11 R |
| 3,461,883 | 8/1969 | Maris | 132/11 R |
| 3,474,795 | 10/1969 | Hantman et al. | 132/11 R |

*Primary Examiner*—G. E. McNeill

*Attorney, Agent, or Firm*—Woodard, Weikart, Emhardt & Naughton

[57] ABSTRACT

Disclosed is a hair styling brush in which the brush portion is axially rotated by finger motion of the operator grasping the handle. The operator actuates a trigger or abutment in the handle to rotate the brush while the handle remains stationary in his grasp as he draws the brush through the hair. Rectilinear movement of the abutment is translated into rotary motion of the brush by a rack and pinion transmission means located within the housing forming the implement handle.

7 Claims, 6 Drawing Figures

HAIR STYLING IMPLEMENT

BACKGROUND OF THE INVENTION

In blow drying and styling of hair, the operator conventionally wields a hand-held electric blow dryer in one hand and brushes the hair, using a cylindrically shaped brush in his other hand. During, or at least as the stroke is completed, the hand-held brush must be axially rotated through an angle of the order of 90°. This turning motion of the brush must be repeated many times and produces operator fatigue, lessening the number of stylings which can be performed by the operator in a working day.

Prior art U.S. Pat. Nos. 3,516,424, 3,962,742 and 4,032,747 disclose conventional hair styling implements but none provide a means for conveniently producing the required rotation of the brush, during the styling stroke, without also rotating the handle.

The present invention provides a means for achieving the required intermittant rotation of the brush without the complex, tiring finger and palm motion required to roll the handle in the grasp of the operator conventionally required to achieve brush rotation where the brush and handle are rigidly joined.

DESCRIPTION OF THE PREFERRED EMBODIMENT

Figure 1:
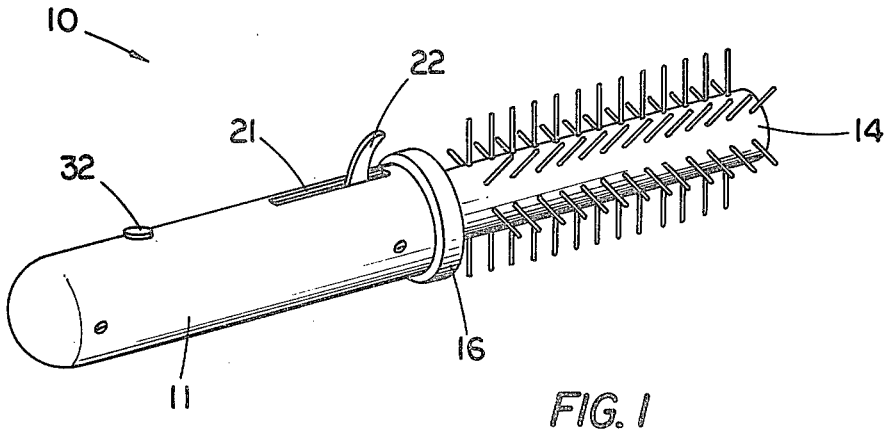
FIG. 1 is a perspective view of a hair styling implement embodying the present invention.

Referring initially to FIG. 1, the hair styling or treating implement includes a handle 10 formed by a tubular housing 11. The housing may, of course, be formed by joining two mating half-pieces to facilitate disassembly and inspection of the housing interior. The housing has extending from it an elongated member or shaft 12 (FIG. 2) which is adapted to removably accomodate a hair treating attachment such as the typical styling brush 14 of FIG. 1. The brush may be held on the shaft 12 by any suitable means such as resilient posts (not shown) extending chordally across the interior of the brush body which snap into the groove 12*a* (FIG. 2) in the shaft 12. Recesses 15 in a collar 16 receive pins on the brush to assure that the brush rotates with the collar shaft 12.

The brush 14 is rotatable with relation to the handle as will be described with reference to FIGS. 2–6. As may be seen in FIG. 2, the shaft 12 is rigidly attached by any suitable means to the collar 16, previously mentioned, which turns with the shaft. The portion of the shaft 12 extending within the housing may be reduced in diameter as indicated at 12*b*. Bearing support members 17 and 18 for the shaft extend radially from the interior surface of the housing. The inner end of shaft 12 has rigidly mounted thereon a bevel gear 19.

The housing 11 is provided with a rectilinear slot 21 through which extends a trigger or abutment member 22 adapted to be moved leftwardly (as viewed in FIG. 1) by the finger of an operator grasping the handle, the freedom of movement of the member 22 being determined by the length of slot 21. The member 22 is carried by an elongated rack member 23 which is supported for rectilinear movement parallel to the handle axis by bearing blocks 24 extending from the inner surface of the housing. A compression spring 26 urges the member 23 into its extreme rightward (as viewed in FIG. 2) position. The member 23 has a toothed or serrated portion 27 which is meshed with a driven gear 28 which is supported by, but free to rotate and slide axially on, a stub shaft 29 which, as may best be seen in FIG. 4, extends diametrically across housing 11 and bottoms in a bearing cup 31.

Figure 4:
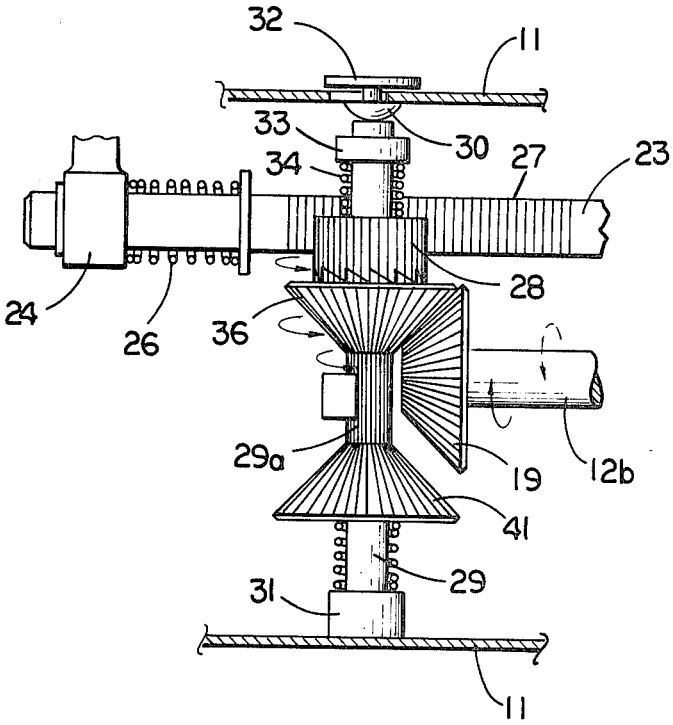
FIG. 4 is an enlarged, fragmentary view of a portion of the structure shown in FIG. 2.
Figure 6:
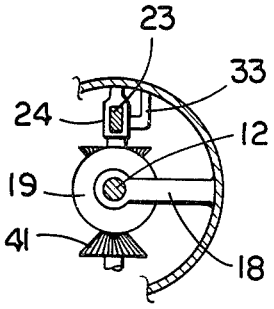
FIG. 6 is a fragmentary, sectional view taken generally along the line 6—6 of FIG. 2.

At one end the shaft 29 engages a cam 30 (FIG. 4) mounted for rotation on the housing 11 and having an exteriorly accessible member 32 for manually rotating the cam 30. In FIG. 4 the shaft 29 has engaged the high portion of the cam lobe and the shaft is thus in its extreme downward (as viewed in FIGS. 2 and 4) position and seated in cup 31 but free to rotate with relation thereto.

At its free end shaft 29 is supported by a bearing member 33 (FIG. 4) and a compression spring 34 urges gear 28 against the wide-end face of bevel gear 36 which is rigidly attached to and rotates with shaft 29. The engaging faces of gears 36 and 28 have meshing ratchet teeth which permit the gear 28 to rotate gear 36 (and hence shaft 29) in the direction indicated by the rotation-arrows in FIG. 4 when rack teeth 27 are moved leftwardly as viewed in FIG. 4. Reverse movement of the rack, reversing rotation of gear 28 transmits no motion to gear 36 because the meshing ratchet teeth on the faces of gears 28 and 36 slip as gear 28 is displaced upwardly (as viewed in FIG. 4) against the force of spring 34. A resilient pawl 37 engagig a splined portion 29*a* of shaft 29 prevents any tendency of shaft to rotate in reverse direction as the ratchet teeth of gears 28 and 36 slip by each other.

Figure 2:
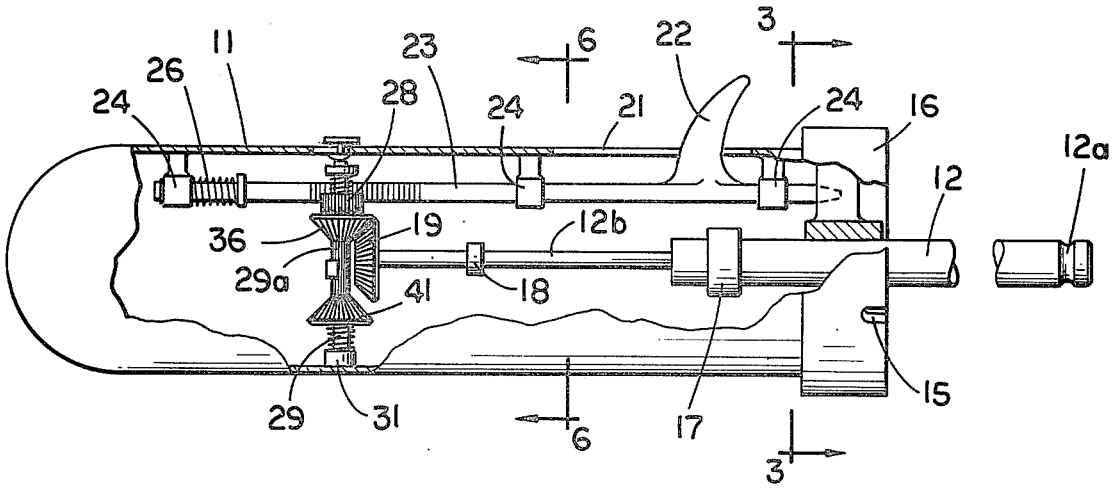
FIG. 2 is a side view, with a portion of the housing broken away, showing the structure of FIG. 1 but with the brush attachment removed.
Figure 3:
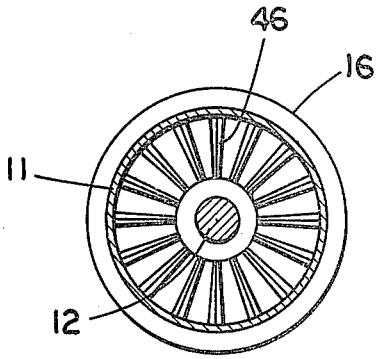
FIG. 3 is a sectional view taken generally along the line 3—3 of FIG. 2.
Figure 5:
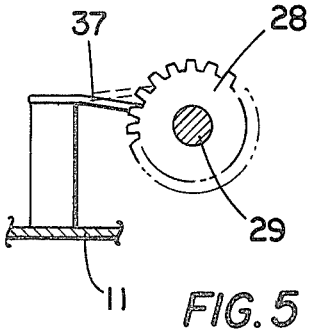
FIG. 5 is an enlarged side view of the pawl member shown in FIG. 4.

In the position shown in FIGS. 2 and 4, the bevel gear 36 meshes with the driven, bevel gear 19 which is locked on the shaft portion 12*b*, rotation of shaft 12 serving to rotate attachment brush 14. The stub shaft 29 also carries the bevel gear 41 which is opposite bevel gear 36 on the shaft 29. A compression spring 42 insures that the free end of shaft 29 is held in engagement with cam 30. It will be understood that when cam 31 is positioned so that shaft 29 engages the flat or shallow portion of the cam, shaft 29 will be positioned upwardly (as viewed in FIGS. 2 and 4), a position in which bevel gear 41 meshes with gear 19 and gear 36 is disengaged therefrom. Such engagement results in shaft 12 turning in the opposite direction (the direction of the broken line arrow in FIG. 4) although shaft 29 does not change its direction of rotation. The member 32 can thus be utilized to select the direction of rotation of the attachment 14 carried by shaft 12.

To assure that the attachment 14 is locked in stationary condition when abutment 22 is in its position of FIG. 2, enabling the implement to be used as a conventional styling brush, the rightward (as viewed in FIG. 2) end of member 23 is somewhat tapered and extends between teeth or ridges 46 (FIG. 3) formed on the inner end and side face of member 16. When abutment 22 is manually actuated, member 16 will be released allowing shaft 12 to rotate.

Operation will be obvious from the foregoing. Holding the implement in one hand by means of handle 10, the operator, at the selected time during the brushing stroke, moves the abutment 22 leftwardly (as viewed in FIG. 1) with a finger of the hand grasping the implement. This, by moving rack 23, rotates shaft 12 and attachment 14, the rotation being limited by the extent of the leftward motion of abutment 22 as defined by the length of slot 21. Upon release of the abutment 22, return spring 26 drives the rack back to its initial, quiescent position. Because of the unidirectional motion transmission connection between the abutment 22 and the shaft 12, described above, the brush attachment is not rotated during this return motion of the rack. If it is desired to reverse the direction of rotation of the brush attachment, member 32 is adjusted to place bevel gear 41 in engagement with gear 19. Actuation of abutment 22 will then rotate the attachment and shaft 12 in the direction indicated by the broken line arrow in FIG. 4.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A hair styling implement comprising a tubular housing forming a handle and an elongated member extending coaxially from the housing adapted to removably accomodate a styling attachment, said elongated member having a portion extending into said housing and being supported therein for rotation about its longitudinal axis with relation to the housing, a rectilinearly moveable abutment extending from a longitudinal slot in said housing and adapted for finger induced motion within the slot by an operator grasping said handle, motion transmission means within said housing operatively connecting said abutment and the portion of the elongated member within the housing for transforming the rectilinear motion of said abutment into rotary motion of said elongated member.

2. A hair styling implement as claimed in claim 1 in which motion of said abutment in one direction only is transmitted by said motion transmission means to said elongated member.

3. A hair styling implement as claimed in claim 2 including an adjusting member for selectively determining the direction of rotation of said elongated member in response to displacement of said abutment.

4. A hair styling implement as claimed in claim 1 in which said motion transmission means includes a toothed rack rigidly attached to said abutment and mounted for rectilinear motion within said housing, a driven gear rotated by motion of said rack, two opposed bevel gears rigidly attached at their facing smaller ends by means of a stub shaft, a unidirectional driving connection between said rack-driven gear and one of said bevel gears whereby rotation of said bevel gears and stub shaft occurs only when said rack is moved in one direction, and a third bevel gear rigidly attached to the said elongated member portion within the housing, and rotation direction selection means accessible at the exterior of the housing for selectively displacing said opposed bevel gears and stub shaft so that one or the other of said opposed bevel gears meshes with said third bevel gear thereby determining the direction of rotation of said elongated member.

5. A hair styling implement as claimed in claim 4 having mounted within said housing a pawl cooperating with a ribbed portion of said stub shaft to restrain the shaft from reverse rotation as said rack moves opposite to said one direction.

6. A hair styling implement as claimed in claim 4 in which said rotation direction selection means includes a cam moveable from the exterior of said housing and engaging said stub shaft, mounting means for the stub shaft that permits both rotation and axial displacement of the shaft, said cam in one position locating the stub shaft axially so that one of said opposed bevel gears meshes with said third bevel gear and in another position locating the stub shaft axially so that the other opposed bevel gear meshes with the third bevel gear.

7. A hair styling implement as claimed in claim 6 in which said stub is disposed transverse to said rack and extends freely through said driven gear.

* * * * *